US010424239B2

(12) United States Patent
Aamold et al.

(10) Patent No.: US 10,424,239 B2
(45) Date of Patent: Sep. 24, 2019

(54) POWER EFFICIENT ADAPTIVE PANEL PIXEL CHARGE SCHEME

(71) Applicant: Apple Inc., Cupertino, CA (US)

(72) Inventors: James Aamold, Campbell, CA (US); Fenghua Zheng, San Jose, CA (US); Sandro H. Pintz, Menlo Park, CA (US)

(73) Assignee: Apple Inc., Cupertino, CA (US)

( * ) Notice: Subject to any disclaimer, the term of this patent is extended or adjusted under 35 U.S.C. 154(b) by 64 days.

(21) Appl. No.: 15/723,085

(22) Filed: Oct. 2, 2017

(65) Prior Publication Data

US 2018/0025689 A1 Jan. 25, 2018

Related U.S. Application Data

(63) Continuation-in-part of application No. 14/487,020, filed on Sep. 15, 2014, now Pat. No. 10,121,410.

(60) Provisional application No. 62/017,098, filed on Jun. 25, 2014, provisional application No. 62/012,185, filed on Jun. 13, 2014.

(51) Int. Cl.

| | |
|---|---|
| ***G09G 3/32*** | (2016.01) |
| ***G09G 3/20*** | (2006.01) |
| ***G09G 3/3216*** | (2016.01) |

(52) U.S. Cl.

CPC ..... *G09G 3/32* (2013.01); *G09G 3/2007* (2013.01); *G09G 3/3216* (2013.01); *G09G 2300/0408* (2013.01); *G09G 2310/027* (2013.01); *G09G 2310/0291* (2013.01); *G09G 2310/08* (2013.01); *G09G 2330/021* (2013.01); *G09G 2330/023* (2013.01); *G09G 2330/028* (2013.01); *G09G 2340/16* (2013.01)

(58) Field of Classification Search

CPC ..... G09G 3/2007; G09G 3/3216; G09G 3/32; G09G 2310/027

See application file for complete search history.

(56) References Cited

U.S. PATENT DOCUMENTS

| | | | |
|---|---|---|---|
| 5,739,804 | A | 4/1998 | Okumura et al. |
| 7,580,047 | B2 | 8/2009 | Ng |

(Continued)

OTHER PUBLICATIONS

Final Office Action issued in U.S. Appl. No. 14/487,020, dated Oct. 4, 2017 in 29 pages.

(Continued)

*Primary Examiner* — Abbas I Abdulselam

(74) *Attorney, Agent, or Firm* — Kilpatrick Townsend & Stockton

(57) ABSTRACT

This application relates to systems, methods, and apparatus for reducing the power consumption of a display panel. Specifically, the embodiments discussed herein relate to a panel pixel charge scheme that allows the current output of a display driver to be modified based on the content to be displayed at the display panel. The display driver can compare current and upcoming display content in order to determine how the line voltage for one or more output lines will change over time. If, based on the comparison, the voltage for an output line is not going to vary substantially over time, the bias current output from the display driver can be modified in order to save power. The modification to the bias current can depend on the amount of change the line voltage will undergo in subsequent executions of the content data.

20 Claims, 10 Drawing Sheets

(56) References Cited

U.S. PATENT DOCUMENTS

| | | | | |
|---|---|---|---|---|
| 10,121,410 | B2 | 11/2018 | Zheng et al. | |
| 2005/0162441 | A1* | 7/2005 | Dawson | G06T 1/60 345/611 |
| 2006/0290638 | A1 | 12/2006 | Kang et al. | |
| 2013/0307838 | A1 | 11/2013 | Kim et al. | |
| 2014/0125708 | A1* | 5/2014 | Chen | G09G 3/2007 345/690 |
| 2015/0187317 | A1* | 7/2015 | Seo | G09G 3/006 345/212 |
| 2015/0228241 | A1 | 8/2015 | Lee et al. | |
| 2015/0364088 | A1 | 12/2015 | Zheng et al. | |

OTHER PUBLICATIONS

Non-Final Office Action issued in U.S. Appl. No. 14/487,020, dated Apr. 7, 2017 in 26 pages.
Non-Final Office Action issued in U.S. Appl. No. 14/487,020, dated Feb. 9, 2018 in 30 pages.

* cited by examiner

POWER EFFICIENT ADAPTIVE PANEL PIXEL CHARGE SCHEME

CROSS-REFERENCE TO RELATED APPLICATIONS

The present application is a continuation-in-part of U.S. patent application Ser. No. 14/487,020 entitled "POWER EFFICIENT ADAPTIVE PANEL PIXEL CHARGE SCHEME" filed Sep. 15, 2014, the contents of which are incorporated herein by reference in its entirety for all purposes. U.S. patent application Ser. No. 14/487,020 claims the benefit of U.S. Provisional Application No. 62/012,185, entitled "POWER EFFICIENT ADAPTIVE PANEL PIXEL CHARGE SCHEME" filed Jun. 13, 2014 and U.S. Provisional Application No. 62/017,098, entitled "POWER EFFICIENT ADAPTIVE PANEL PIXEL CHARGE SCHEME" filed Jun. 25, 2014, the contents of which are incorporated herein by reference in their entirety for all purposes.

FIELD

The described embodiments relate generally to saving power in a display panel. Specifically, the embodiments set forth herein relate to systems, methods, and apparatus for optimizing a current setting of a display driver in a display panel based on display content.

BACKGROUND

Display monitors have become increasingly more advanced as a result of new devices and materials being incorporated into display monitors. Although many new materials can allow a display monitor to provide exquisite images, certain materials can require large amounts of energy. Additionally, such materials can require a large buffer of current that is constantly being depleted and recharged in order to accurately display image data at the display monitor. Specifically, in display monitors having light emitting diode (LED) matrices, there is a high demand of current and voltage when the display monitor is constantly transitioning the LED's between different levels of operation. This issue is exacerbated in higher resolution displays where LED matrices are denser and the combined energy demand for the rows and columns of the LED matrices is substantial.

SUMMARY

This paper describes various embodiments that relate to systems, methods, and apparatus for reducing the power consumption of a display device. The embodiments discussed herein include a method for providing a data line output from a display driver of a display device. The method can include a step of providing a modified bias current of the display driver according to a line charge differential. The line charge differential can be generated based on a comparison between at least one bit of a current display variable and a subsequent display variable.

In other embodiments, a system for reducing power consumption of a display device based on content data to be displayed at the display device is set forth. The system can include a display driver electrically coupled to a data input unit. The display driver can be configured to modify a bias current output of the display driver when content data provided by the data input unit is indicative of a charge differential that is within one or more charge differential thresholds accessible to the display driver.

In yet other embodiments, a display driver configured to reduce power consumption based on content data is set forth. The display driver can include a current output unit, and a data control unit. The data control unit can be configured to determine a modified bias current for the current output unit based on a voltage differential generated by sequentially comparing a first content variable to a second content variable. The second content variable can be arranged to be executed subsequent to the first content variable.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The disclosure will be readily understood by the following detailed description in conjunction with the accompanying drawings, wherein like reference numerals designate like structural elements.

DETAILED DESCRIPTION

Figure 1A:
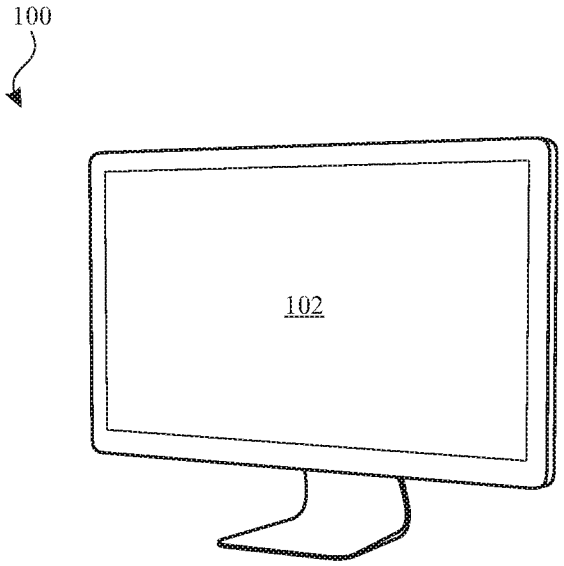
FIGS. 1A and 1B illustrate perspective views of a display panel and a light emitting diode (LED) matrix diagram.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

The embodiments discussed herein relate to apparatus, systems, and methods for reducing the energy consumption in a display panel. Specifically, the embodiments relate to a power efficient adaptive panel pixel charge scheme. The charge scheme allows one or more display drivers or timing controllers of a display panel to charge a data line in a light emitting diode (LED) matrix according to a current content data and future content data, as further discussed herein. An LED will receive current when both the data line, corresponding to the column of the LED matrix, and the row line, corresponding to the row of the LED matrix, receives adequate charge. A row is charged by a row driver and a data line is charged by a display driver or column driver. The data line is frequently recharged by the display driver in order to illuminate LED's in multiple rows. However, a data line can retain some charge after illuminating an LED in a row line and subsequently use some of the remaining charge to illuminate an LED in an adjacent or subsequent row line. As discussed herein, the display driver can be configured to reduce a bias current to the data line when illuminating LED's in subsequent or neighboring rows depending on the content data provided to the display driver.

The content data can refer to bits of an array that determine the various levels of an analog signal that will drive the data line. For example, the display driver can have a 6, 8, or 10 bit resolution, and the square of the resolution will determine the number of levels of analog signals (i.e., $2^8=256$). Depending on the content data, a voltage will be established at the data line according to one of the levels of analog signal defined by the data content. Therefore, the voltage at the data line will change depending on how the content data changes from row line to row line. The relationship between the voltage and the bias current needed to charge the data line can be defined by the following formula:

$$I \cdot \Delta t = C \cdot \Delta V \quad (1)$$

In this formula, the settling time ($\Delta t$) refers to a change in settling time that the data line can take to reach a voltage or charge level corresponding to the content data. The capacitance (C) refers to the capacitance of the data line. The bias current (I) refers to a bias current at the data line that can achieve a voltage change ($\Delta V$). The voltage change ($\Delta V$) refers to a difference between an initial and final voltage at the data line. During operation of the display driver, the content data can cause the display driver to change the output voltage by less than half of the maximum output voltage (the output voltage corresponds to the analog signal level). In this case, and according to the formula above, a settling time ($\Delta t$) would be less than half for the same bias current (I) because the voltage change ($\Delta V$) is less than half. Furthermore, in order to achieve the same settling time ($\Delta t$) when the voltage of the data line remains constant, less than half of the bias current (I) will be needed because the voltage change ($\Delta V$) is even less when the voltage of the data line remains constant. Therefore, by reducing the bias current based on content data to be executed at the display panel, a substantial amount of power can be saved.

An algorithm for reducing the bias current according to the content data can be performed in a variety of ways according to the embodiments described herein. In some embodiments, a data control unit coupled to a display driver or column driver, or the display driver itself, can generate a control signal for modifying the bias current according to current content data and subsequent content data. The data control unit can determine the difference between a current analog signal level corresponding to the current data content and a subsequent analog signal level corresponding to subsequent content data. The difference can be based on one or more bits (e.g., a most significant bit for content data) provided to the data control unit. For example, if the subsequent content data is to have an analog signal level that is a percentage value less than the analog signal level of the current content data, the data control unit will use the percentage value to reduce the bias current for the subsequent content data. After current content data is executed and the first row line (N) is energized, the bias current is adjusted according to a modified bias current value. The modified bias current value can be a fraction or percentage of the bias current used for the current content data, or a fraction or percentage of a normal bias current used when executing the subsequent content data. Thereafter, the data line is charged with the modified bias current when the subsequent content data is executed. This algorithm can be applied to all rows of an LED matrix in a display panel. Upon the final row being charged and a blank period occurring before a subsequent frame is provided to the LED matrix, the bias current can be restored to a normal value for illuminating the LED's of the LED matrix. For example, the normal value can correspond to the maximum analog signal level or a media analog signal level for preparing the display driver for a worst case charging scenario.

These and other embodiments are discussed below with reference to FIGS. 1-7; however, those skilled in the art will readily appreciate that the detailed description given herein with respect to these figures is for explanatory purposes only and should not be construed as limiting.

Figure 1B:
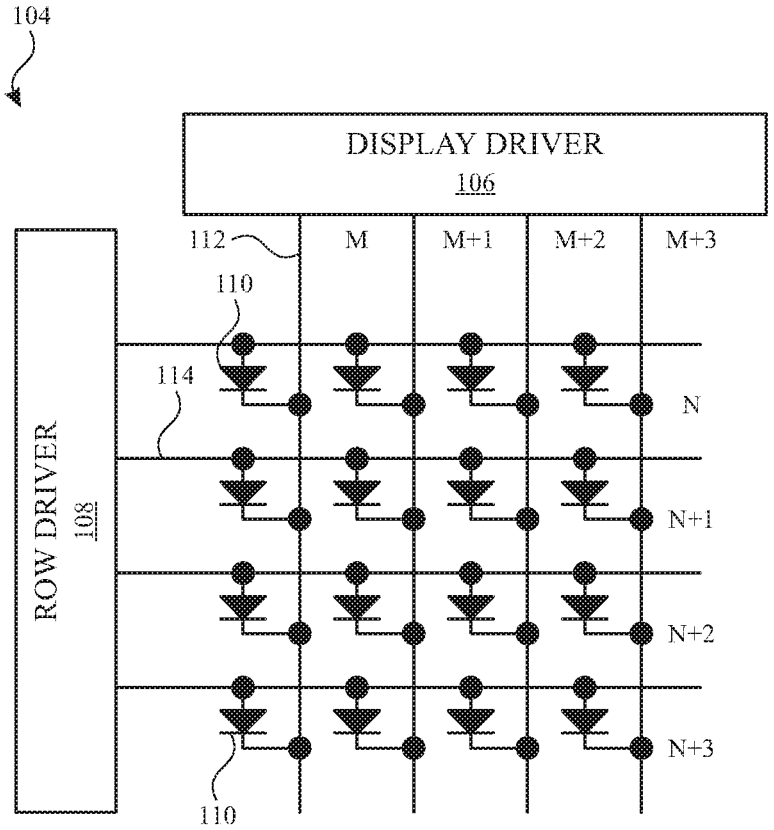

FIGS. 1A and 1B illustrate perspective views of a device 100 with a display panel 102 and an LED matrix diagram 104. The display panel 102 can be a desktop computer using an LED matrix to output light at the display panel 102. Additionally, display panel as used herein can refer to the display of a laptop computing device, desktop computing device, media player, cellular phone, or any other electronic device incorporating a display having LED's. FIG. 1B illustrates an LED matrix diagram 104 for use in the display panel 102, or any other suitable display device. In order to cause an LED 110 to illuminate, each data line 112 and row line 114 is individually provided electrical current. For example, in order to illuminate the LED 110 at row N+1 and column M+1, both row N+1 and column M+1 must concurrently receive electrical current. If the next LED 110 to be illuminated is the LED 110 corresponding to row N+2 and column M+1, the display driver 106 may continue providing a bias current to column M+1 until the row driver 108 stops the current at row N+1 and provides current to N+2. By keeping the bias current at column M+1, the display driver 106 is prepared to assist in illuminating other LED's. However, this can result in wasted power when the LED 110 in the next row and same data line requires the same amount of charge or a percentage of the charge as required by an LED 110 in the previous row and same data line. For example, when the column requires the same amount of voltage for a subsequent row, the bias current required for the column will be less for the subsequent row because the data line will already have some charge or voltage remaining. This is the result of the capacitance of the data line being small compared to the capacitance of a pixel to be illuminated by the LED 110. Therefore, the display driver 106, or a data control unit communicatively coupled to the display driver 106, can determine how much to reduce the bias current in order to save power and still provide adequate charge to the data line for different content data.

Figure 2:
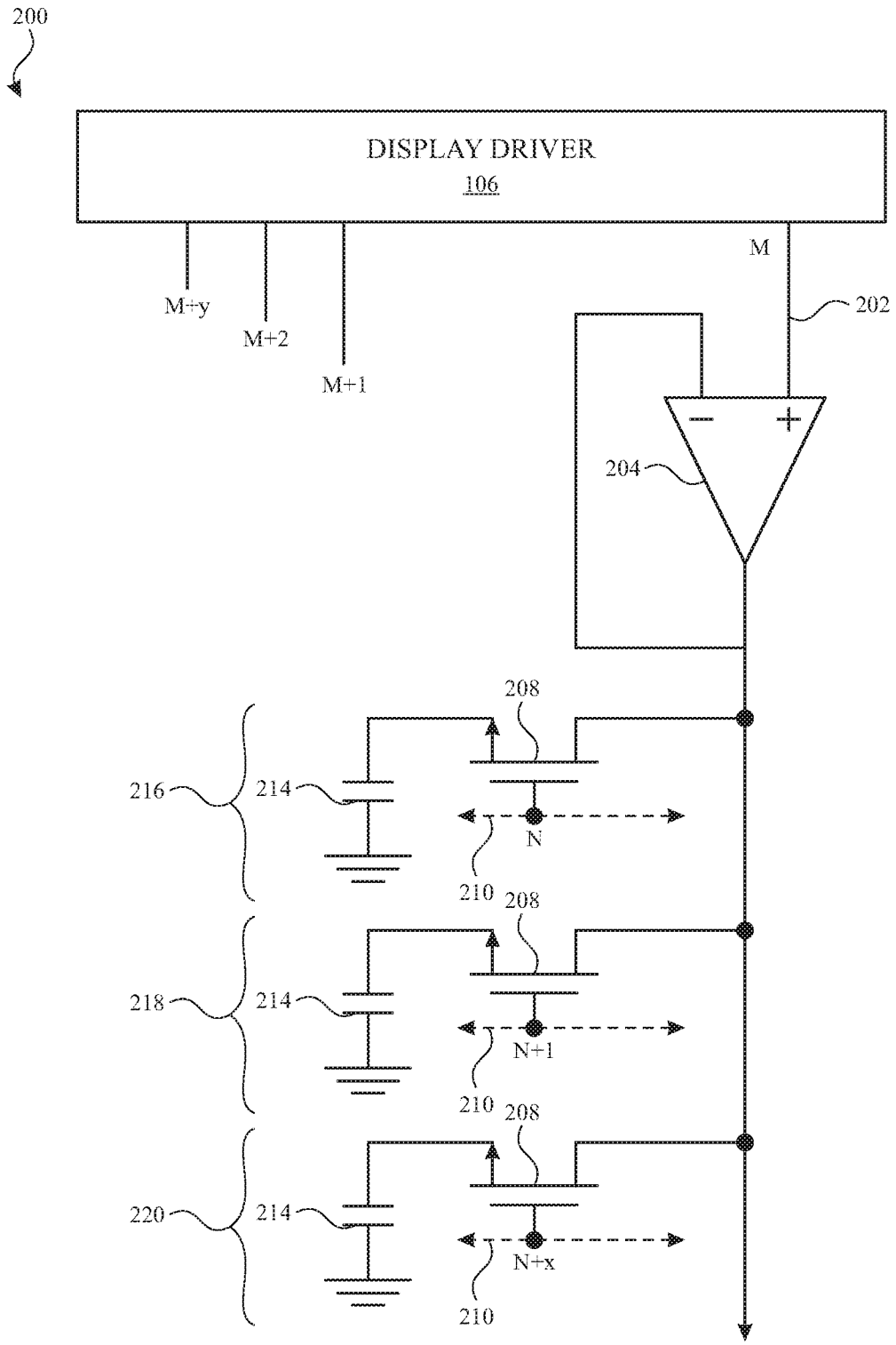
FIG. 2 illustrates a diagram of a display driver configured to adaptively reduce the power consumption of a display panel according to some embodiments discussed herein.

FIG. 2 illustrates a diagram 200 of a display driver 106 configured to adaptively reduce the power consumption of a display panel 102 according to some embodiments discussed herein. The display driver 106 can be electrically coupled to one or more data lines 202 (e.g., M, M+1, M+1, M+2, M+y, and so on for y>1). The output of the display driver 106 is a bias current, which can be buffered in the data line buffer 204 prior to reaching each of the transistors 208. Each of the transistors 208 are connected to the data line 202 at a portion of the data line corresponding to a row of an LED matrix, in which the display driver 106 can be electrically coupled to. For example, a transistor 208 is coupled at the first row 216, second row 218, and third row 220, in order to allow or prevent charge from being received at each storage capacitor 214. The storage capacitors 214 store a pixel voltage, which is used to control the LED current at each row and column. Each transistor 208 can be electrically coupled to a row driver or other device suitable for providing current to the LED's in each row line 210 (e.g., N, N+1, N+x, and so on for x>1) according to the data content to be displayed at the display panel 102.

In some embodiments, the display driver 106 can operate to adjust a voltage and/or current of an individual data line 202. In other embodiments, the display driver 106 can be divided into several sections (e.g., 4 sections). In this way, each section has its own bias current setting in order to accomplish the power saving scheme discussed herein without having to manage a larger number of data lines 202. For example, a 960-channel display driver 106 can be divided into four 240-channel sections, so that each 240-channel section can have its own bias current generation circuit. Thereafter, the maximum level of each 240-channel section can be used to set the bias current for that 240-channel section.

Figure 3A:
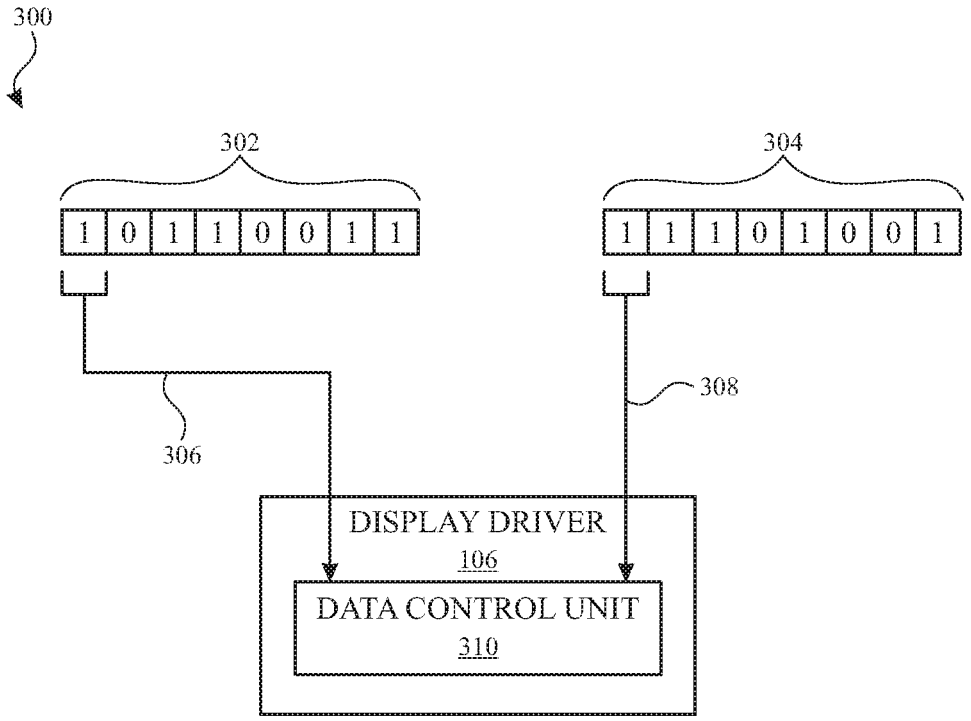
FIGS. 3A and 3B illustrate block diagrams and for executing the adaptive power saving scheme according to some embodiments discussed herein.
Figure 3B:
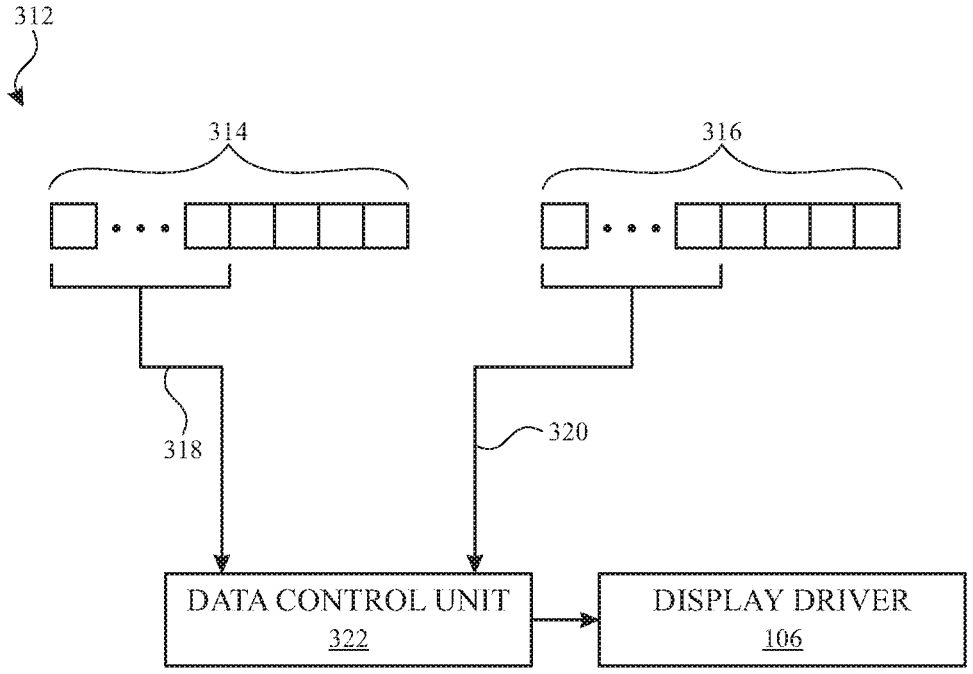

FIGS. 3A and 3B illustrate block diagrams 300 and 312 for executing the adaptive power saving scheme discussed herein. Specifically, FIG. 3A illustrates a block diagram 300 of a data control unit 310 receiving bits corresponding to analog signal levels that the display driver 106 can output for a particular LED in a particular row. In some embodiments, the data control unit 310 can receive a first most significant bit (MSB) 306 and a second MSB 308. The first MSB 306 can correspond to first content data 302 and the second MSB 308 can correspond to second content data 304 to be executed subsequent to the first content data 302. FIG. 3A provides an example where the first MSB 306 and second MSB 308 have the same MSB's (in this example, an MSB equal to 1). In order to perform the adaptive power saving scheme, the data control unit 310 will compare the MSB 306 and the second MSB 308. Because the first MSB 306 and second MSB 308 are the same, the voltage difference is less than half of the full scale of analog signal levels. In this case, the bias current can be set to 50% of the normal value used to charge the data line for the first content data 302. After the first content data 302 is executed, the settings for the second content data 304 are used to set the display driver 106 voltage and/or bias current to 50% of the normal value in order to save power. This process can continue for each subsequent content data until the end of a frame of content data. When a blank period is reached, corresponding to when the next frame is to be displayed at the display panel, the bias current can be restored so the data line can be charged in order to prepare for the content data in the next frame.

FIG. 3B illustrates block diagram 312 for executing the adaptive power saving scheme by comparing multiple bits of each content data. Specifically, FIG. 3B illustrates the data control unit 322 comparing sets of two or more bits from each of the first content data 314 and the second content data 316. In some embodiments, each of the first content data 314 and the second content data 316 can be less than or greater than 8-bits. Additionally, the data control unit 322 can be an entity in hardware or software that is external to the display driver 106, as illustrated in FIG. 3B. When comparing the sets of two or more bits, the data control unit 322 will determine the change in output voltage or analog signal level indicated by the differences in the sets of two or more bits from each of the first content data 314 and the second content data 316. For example, if there is a 20% change in output voltage, then the bias current corresponding to the second content data 316 can be set to 20% of the normal value. In some embodiments, any suitable percentage change in voltage can reduce the bias current in order to save power. In other embodiments, the percentages can be set according to a few set values separated by a fixed voltage change interval (e.g., 50% and 100%; or 25%, 50%, 75%, and 100%). Using four intervals, 0-25% voltage change will result in a 25% bias current; a 25-50% voltage change will result in a 50% bias current; a 50-75% voltage change will result in a 75% bias current, and a 75-100% change will result in a 100% bias current. For white, black, mosaic, or most web pages, the power savings can be 50% when only a two thresholds or intervals are used. Moreover, 75% power savings can be manifested using more intervals such as the four interval example described herein. Although the examples provided herein include two and four interval settings, it should be noted that more or less voltage change intervals corresponding to percentage changes in bias current can be provided in order to save power by reducing bias current.

Figure 4:
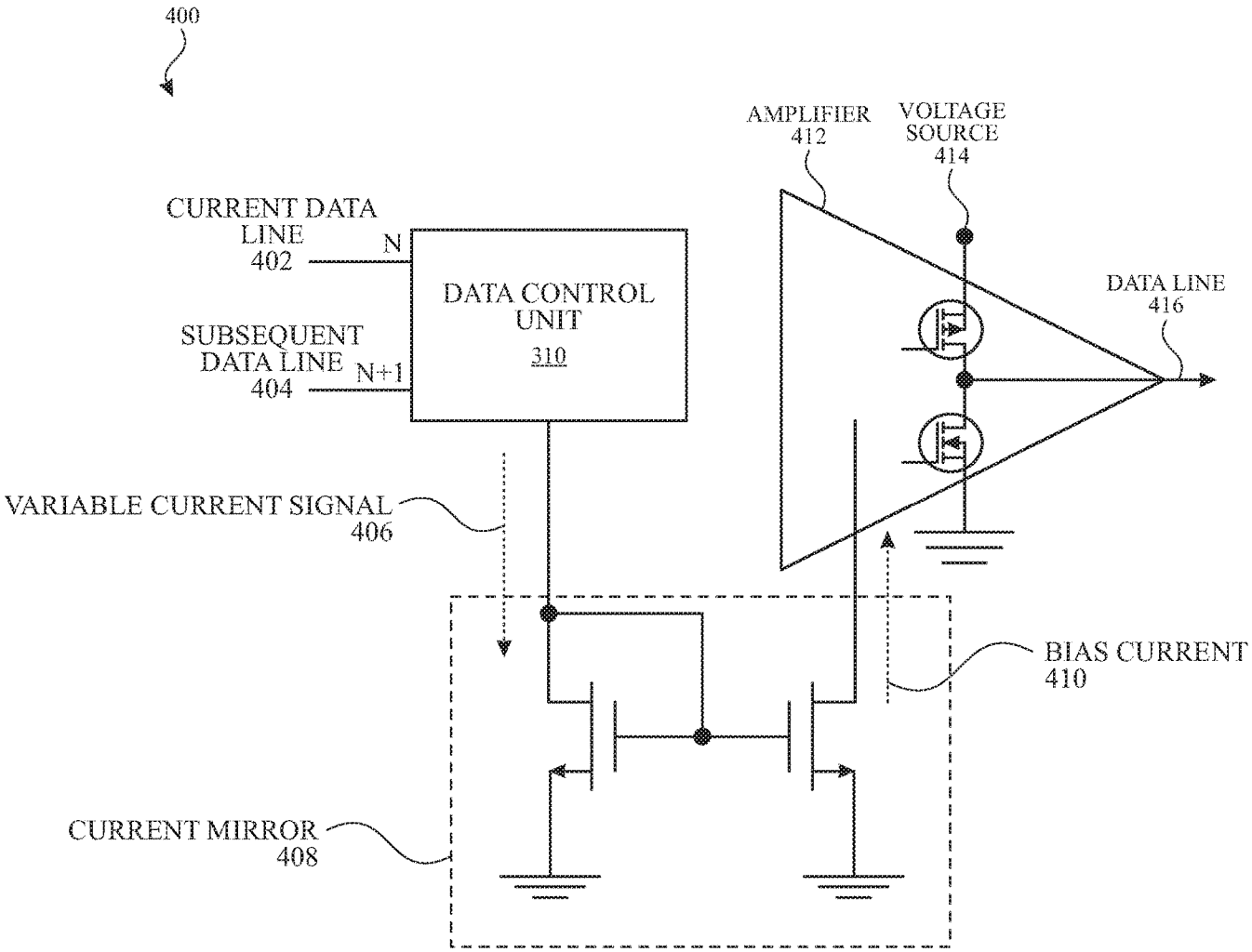
FIG. 4 illustrates a diagram for providing a bias current to a data line according to some embodiments discussed herein.

FIG. 4 illustrates a diagram 400 for providing a bias current to a data line 416 according to some embodiments discussed herein. According to FIG. 4, the current line data 402 corresponding to row N, and the subsequent line data 404 corresponding to row N+1 are provided to the data control unit 310. Each of the current line data 402 and the subsequent line data 404 can correspond to pixel values for the LED's associated with the data line 416 and row N and N+1, respectively. Based on a comparison between the current line data 402 and the subsequent line data 404, a variable current signal 406 is generated for the subsequent line. The variable current signal 406 can be provided to a current mirror 408, which is used to generate the bias current 410. Thereafter, the bias current 410 can be provided to an amplifier 412 connected to a voltage source 414 in order to amplify or otherwise condition the bias current 410 for the data line 416.

Figure 5:
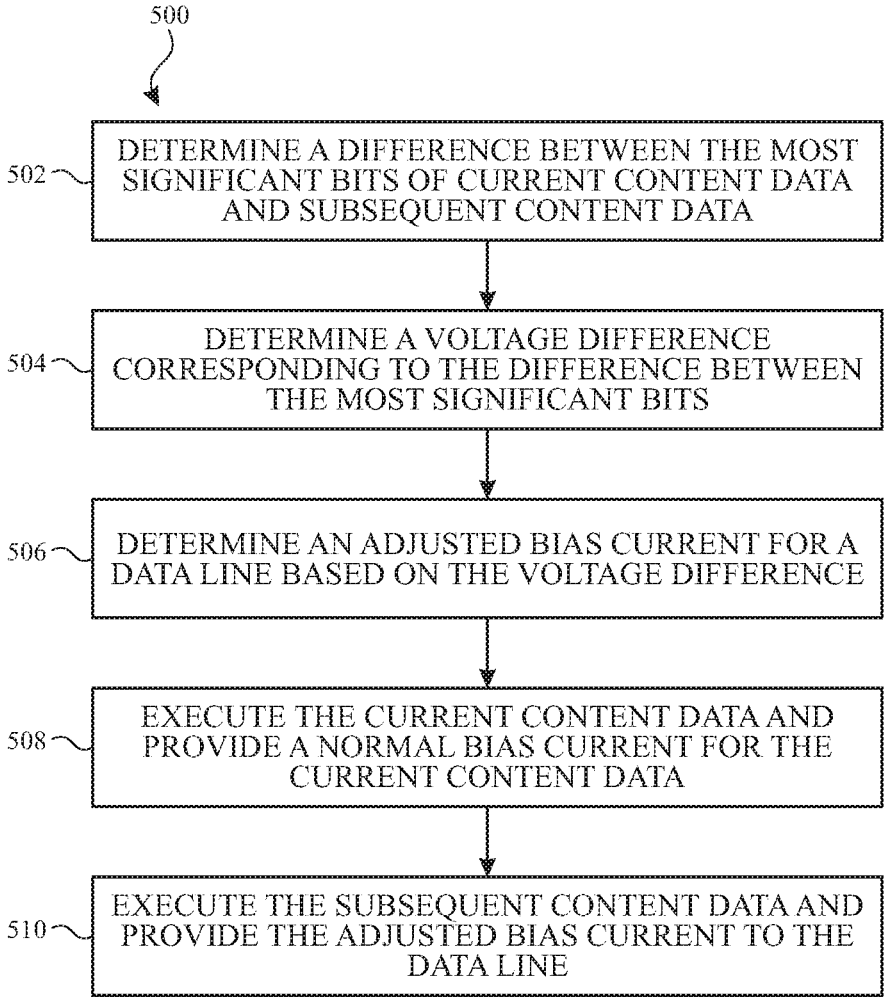
FIG. 5 illustrates a method for sequentially adjusting a bias current for a data line based on data content to be displayed at a display panel.

FIG. 5 illustrates a method 500 for sequentially adjusting a bias current for a data line based on data content to be displayed at a display panel. The method 500 can be performed by the display driver discussed herein, or any other suitable device or software for reducing the power consumption of a display panel. The method 500 can include a step 502 where a difference between the most significant bits of current content data and subsequent content data is determined. The content data can be a binary array of values corresponding to a desired analog signal level for a display driver. In this way, the display driver will adjust an analog signal output based on the desired analog signal level indicated in the content data. At step 504, a voltage difference corresponding to the difference between the most significant bits (from step 502) is determined. For example, when the display driver is instructed by the content data to reduce the analog signal output of a data line, there will be a difference in voltage at the data line before and after the reduction of the analog signal output. At step 506, an adjusted bias current for a data line is determined based on the voltage difference. At step 508, the current content data is executed according to a normal bias current for the current content data, or the bias current that is assigned to the value of the current content data. At step 510, the subsequent content data is executed and the adjusted bias current is provided to the data line accordingly.

Figure 6:
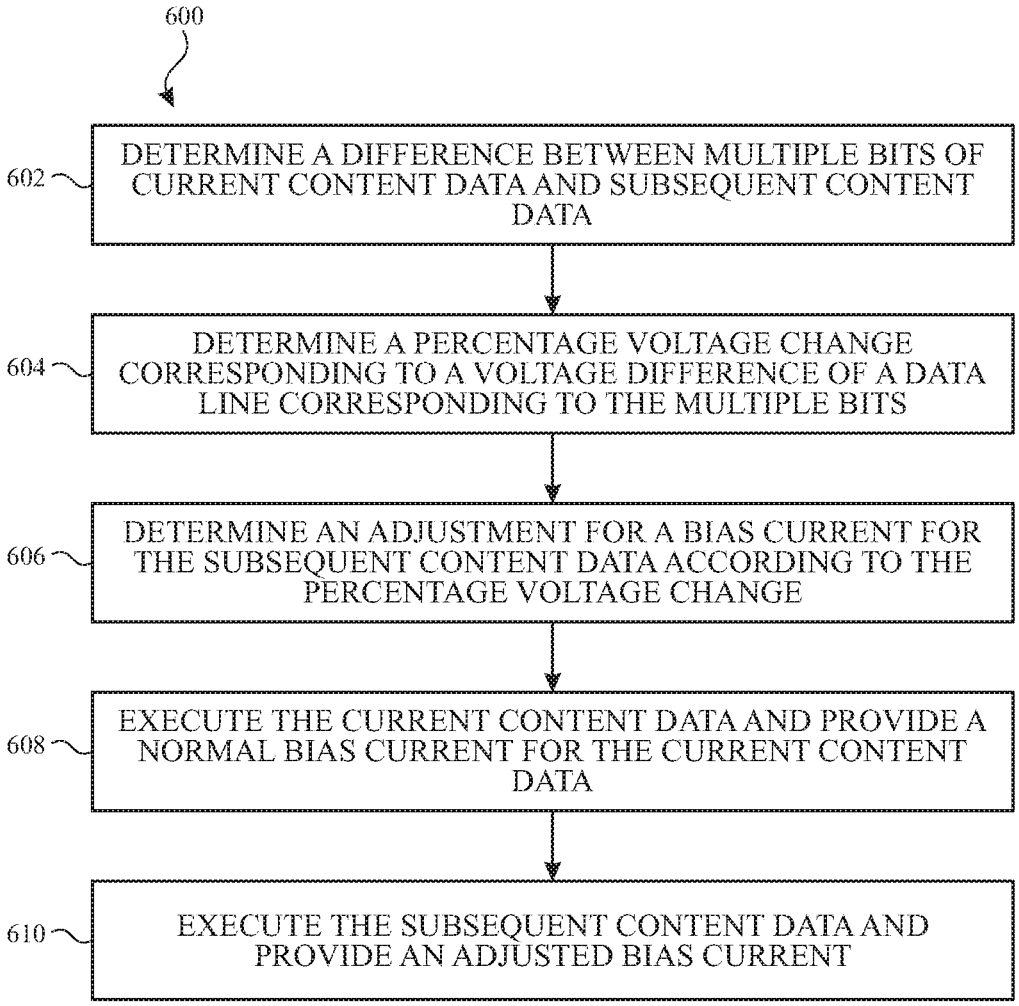
FIG. 6 illustrates a method for sequentially adjusting the bias current at a data line of a display panel in order to reduce the power consumption of the display panel.

FIG. 6 illustrates a method 600 for sequentially adjusting the bias current at a data line of a display panel in order to reduce the power consumption of the display panel. The method 600 can be performed by the display driver discussed herein, or any other suitable device or software for reducing the power consumption of a display panel. The method 600 can include a step 602 where a difference between multiple bits of current content data and subsequent content data are determined. The content data can correspond to the analog signal that is to be output from a display driver to a data line of a display panel in order to effectively illuminate an LED when the data line and a row line are concurrently charged. At step 604, a percentage voltage change corresponding to the difference between the multiple bits is determined. For example, each of the current content data and subsequent content data can correspond to an analog voltage output of the display driver. The analog voltage output can be a range of values depending on the size of the array in which the multiple bits are included. The multiple bits of each of the current content data and subsequent content data can include a most significant bit, as discussed herein, and/or any adjacent or neighboring bits to the most significant bit. At step 606, an adjustment for a bias current for the subsequent content data is determined according to a percentage of voltage change or voltage differential. For example, when there is no voltage change indicated (i.e., a voltage differential of approximately zero), the bias current can be reduced significantly (e.g., by half) for the subsequent content data because less bias current is required to keep the same voltage at the data line. However, if there is a significant change in voltage (e.g., 100% change), the bias current for the subsequent content data can be configured to not be reduced. In this way, because additional bias current may be required to adequately charge the data line when executing the subsequent content data, the bias current should not be reduced to save power in this instance. At step 608, the current content data is executed according to the normal bias current that is associated with the current content data. The normal bias current associated with the current content data can be determined by the data control unit discussed herein, or any other suitable mechanism or software for determining a current level (e.g., a lookup table stored in memory). At step 610, the subsequent content data is executed according to the determined adjustment for the subsequent content data.

Figure 7:
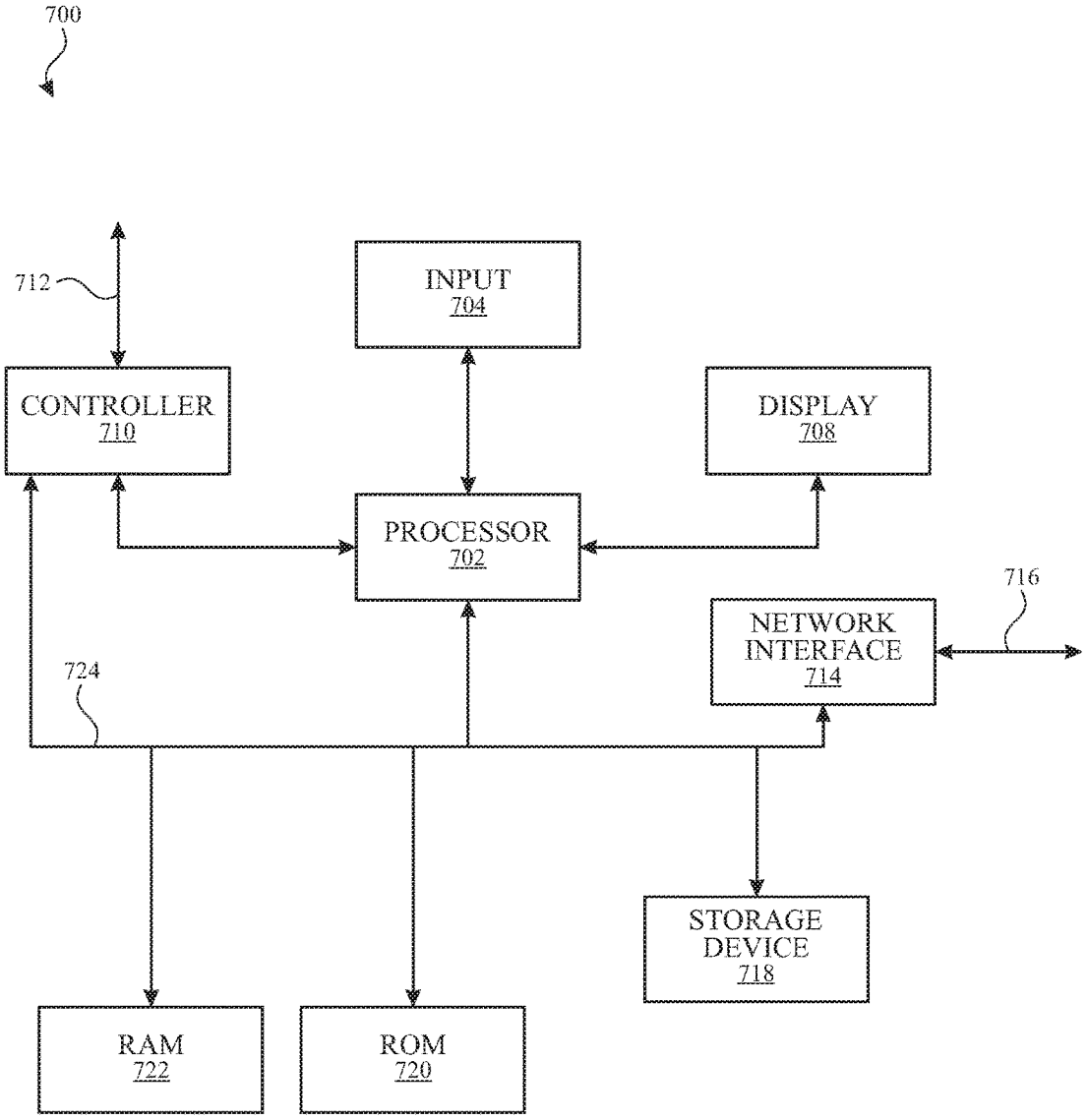
FIG. 7 is a block diagram of a computing device that can represent the components of the data control unit, display driver, and/or any other systems or apparatus discussed herein for reducing the power consumption of a display panel.

FIG. 7 is a block diagram of a computing device 700 that can represent the components of the data control unit 310, display driver 106, and/or any other systems or apparatus discussed herein for reducing the power consumption of a display panel. It will be appreciated that the components, devices or elements illustrated in and described with respect to FIG. 7 may not be mandatory and thus some may be omitted in certain embodiments. The computing device 700 can include a processor 702 that represents a microprocessor, a coprocessor, circuitry and/or a controller for controlling the overall operation of computing device 700. Although illustrated as a single processor, it can be appreciated that the processor 702 can include a plurality of processors. The plurality of processors can be in operative communication with each other and can be collectively configured to perform one or more functionalities of the computing device 700 as described herein. In some embodiments, the processor 702 can be configured to execute instructions that can be stored at the computing device 700 and/or that can be otherwise accessible to the processor 702. As such, whether configured by hardware or by a combination of hardware and software, the processor 702 can be capable of performing operations and actions in accordance with embodiments described herein.

The computing device 700 can also include user input device 704 that allows a user of the computing device 700 to interact with the computing device 700. For example, user input device 704 can take a variety of forms, such as a button, keypad, dial, touch screen, audio input interface, visual/image capture input interface, input in the form of sensor data, etc. Still further, the computing device 700 can include a display 708 (screen display) that can be controlled by processor 702 to display information to a user. Controller 710 can be used to interface with and control different equipment through equipment control bus 712. The computing device 700 can also include a network/bus interface 714 that couples to data link 716. Data link 716 can allow the computing device 700 to couple to a host computer or to accessory devices. The data link 716 can be provided over a wired connection or a wireless connection. In the case of a wireless connection, network/bus interface 714 can include a wireless transceiver.

The computing device 700 can also include a storage device 718, which can have a single disk or a plurality of disks (e.g., hard drives) and a storage management module that manages one or more partitions (also referred to herein as "logical volumes") within the storage device 718. In some embodiments, the storage device 718 can include flash memory, semiconductor (solid state) memory or the like. Still further, the computing device 700 can include Read-Only Memory (ROM) 720 and Random Access Memory (RAM) 722. The ROM 720 can store programs, code, instructions, utilities or processes to be executed in a non-volatile manner. The RAM 722 can provide volatile data storage, and store instructions related to components of the storage management module that are configured to carry out the various techniques described herein. The computing device 700 can further include data bus 724. Data bus 724 can facilitate data and signal transfer between at least processor 702, controller 710, network interface 714, storage device 718, ROM 720, and RAM 722.

Various examples have been described herein in which bias currents are modified based on line comparisons at a data control unit. However, reductions in power consumption and/or other improvements in display function such as improvements in transient load response can be provided by controlling overall power to the display panel based on content to be displayed, rather than locally controlling bias currents at the data control units (which can add a potentially undesirable processing load at the display panel).

For example, power management integrated circuits (PMICs) are sometimes included in a display to provide a supply voltage to the display panel. A PMIC can be controlled in real time (e.g., on a line-by-line basis or for each group of two, three, four, or more than four lines of pixel data) based on the content to be displayed, without modifying the bias currents at the data control units. A timing controller (TCON) that receives lines of pixel data for display by each row (line) of pixels can generate, based on the received line data, power control commands for the PMIC. The TCON-generated power control commands can include a supply voltage setting based on a next line of pixel data to be displayed and/or a power boost command to improve an upcoming transient when the next line of pixel data is significantly different (e.g., different by more than a threshold) from a previous or current line of pixel data being displayed).

Figure 8:
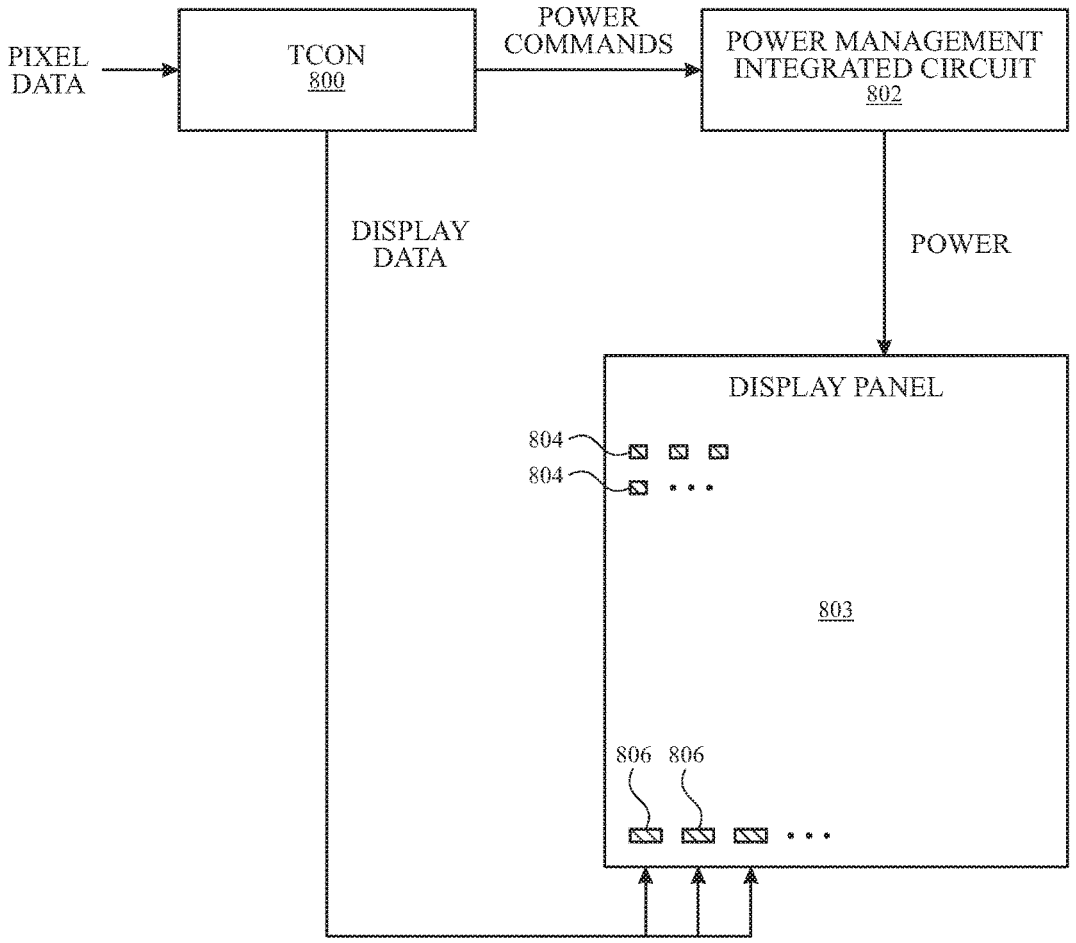
FIG. 8 is a block diagram of display control circuitry for content-based power management in accordance with various aspects of the subject technology.

FIG. 8 shows an example of display circuitry that can be used for content-based power control for a display panel, in accordance with various aspects of the disclosure. FIG. 8 includes display panel 803, which may be an implementation of display panel 102 of FIG. 1 and/or display 708 of FIG. 7. As shown in FIG. 8, display circuitry for device 100 may include a timing controller (TCON) 800 and a power management integrated circuit (PMIC) 802, each communicatively coupled to display panel 803.

In the example of FIG. 8, display panel 803 includes a matrix of pixels 804 (e.g., liquid crystal display pixels or light-emitting diode pixels such as pixels including LEDs 110 as in the example of FIG. 1B). As shown, TCON 800 provides display data to display panel 803 for display using pixels 804. TCON 800 may provide the display data to display panel 803 on a line-by-line basis in which each line of pixel data from TCON 800 is for display using a row of pixels 804.

The pixel data from TCON 800 may be provided to one or more driver circuits 806 on the display panel. For example, each driver circuit 806 may be a column driver integrated circuit that drives pixels 804 in one or more columns based on the pixel data received from TCON 800. Driver circuits 806 may perform one or more of the functions described above in connection with display driver 106 and may include one or more data control units 306 as described herein.

Although not explicitly shown in FIG. 8 is should be appreciated that display panel 803 also includes one or more row drivers such as row driver 108 and one or more data lines and one or more row lines coupled between pixels 804 and the relevant driver circuit as described in connection with FIG. 1B (for example).

During operation of device 100, system circuitry such as processor 702 may produce data that is to be displayed on display panel 803. This pixel data may be provided to display control circuitry such as TCON 800 (e.g., directly or via a graphics processing unit (GPU)).

TCON 800 may provide digital display data to column driver circuits 806. Column driver circuits 806 may receive the digital display data from TCON 800. Using digital-to-analog converter circuitry within column driver circuits 806, column driver circuits 806 may provide corresponding analog output signals on data lines such as data lines 112 (see FIG. 1B) running along the columns of pixels 804.

TCON 800, column drivers 806, and, for example, gate drivers of row driver 108 may sometimes collectively be referred to herein as display control circuitry. Display control circuitry may be used in controlling the operation of display panel 803. Display control circuitry may be implemented, in some configurations, in a common package such as a display driver, a display controller, a display driver integrated circuit (IC), or a driver IC. A graphics processing unit may perform image or other graphics processing on display data received from processor 702 prior to providing the display data from TCON 800 for display using pixels 804. The graphics processing unit may be a separate processing controller from processor 702 or may be implemented as a part of processor 702 (e.g., in a common SOC). Although a single gate/scan line 114 and a single data line 112 for each pixel are illustrated in FIG. 1B, this is merely illustrative and one or more additional row-wise and/or column-wise control lines may be coupled to each pixel 804 in various implementations.

As indicated in FIG. 8, TCON 800 generates and provides power commands to PMIC 802. Power commands from TCON 800 include instructions that cause PMIC to provide power to display panel 803 at a particular supply voltage, at particular times. For example a new power command may be provided from TCON 800 to PMIC 802 for every line of pixel data provided to display panel 803. As another example, TCON 800 may buffer two or more lines of pixel data and provide power commands to PMIC in advance of providing those lines of pixel data to display panel 803. Buffering lines of pixel data in this way can allow TCON 800 to instruct PMIC 802 to pre-compensate the supply voltage for an upcoming transient to be caused by differences, line-to-line, in the pixel data.

Figure 9:
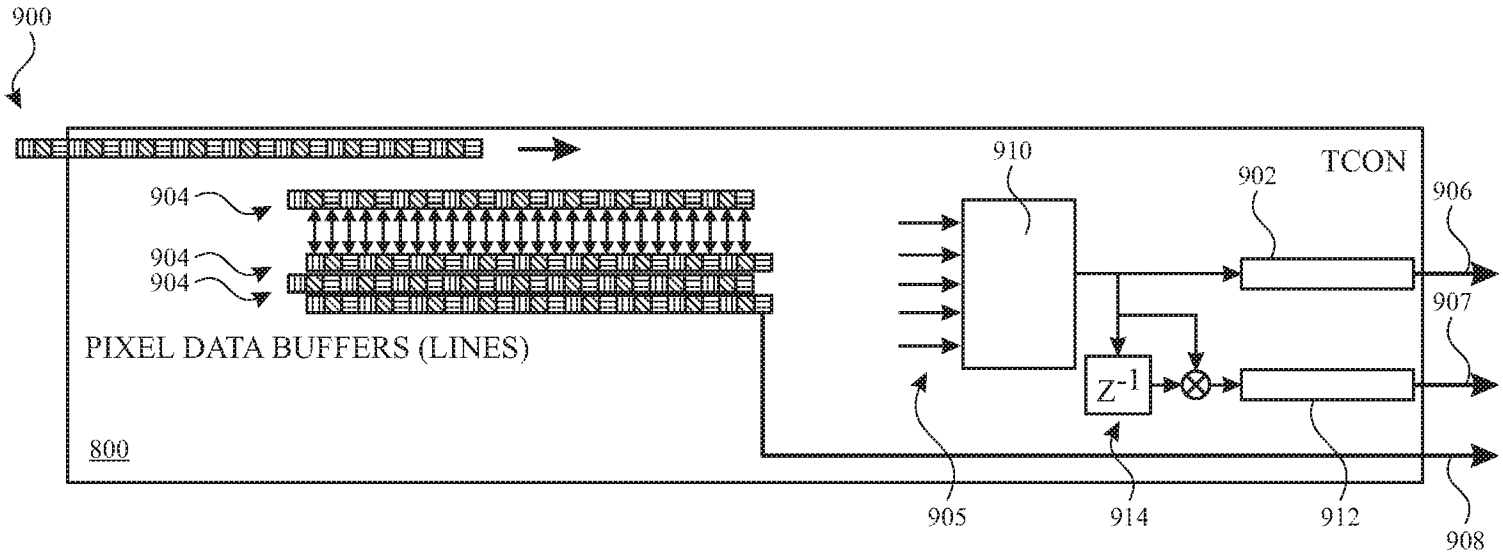
FIG. 9 is a block diagram of a timing controller for content-based power management in accordance with various aspects of the subject technology.

FIG. 9 schematically illustrates TCON operations of TCON 800 for generating power commands for PMIC 802 based on content to be displayed. As shown in FIG. 9, a line (or row) 900 of pixel data may be received (e.g., from system circuitry and/or a GPU) at TCON 800. TCON 800 outputs display data based on the line of pixel data at a desired time to display panel 803 along output path 908.

The line of pixel data may also be provided to power management circuit 910 of TCON 800 which determines an expected amount of power to be used in operating pixels 804 to display that line 900 of pixel data. Signal generator 902 provides a power command along output path 906 to PMIC 802 instructing PMIC 802 to provide a supply voltage sufficient to provide the determined expected amount of power.

In the example of FIG. 9, multiple inputs 905 to power management circuit 910 are provided based on one or more buffered lines of pixel data in line buffers 904. However, this is merely illustrative and power management circuit 910 may determine an amount of power to be used for each line of pixel data without storing the pixel data in line buffers 904. Full lines of pixel data may be provided along each input line 905 (e.g., directly or from a corresponding line buffer 904) or an amount of power for each line of pixel data may be predetermined (e.g., by other circuitry in the TCON) and provided at inputs 905.

However, in implementations in which line buffers 904 are provided, each of several adjacent lines of pixel data may be stored and provided to power management circuit 910. Power management circuit 910 may determine a maximum amount of power to be used in operating pixels 804 to display any of the buffered lines of pixel data and signal generator circuit 902 may instruct PMIC 802 to provide sufficient power for the maximum power line of the buffered pixel data.

In implementations in which line buffers 904 are provided, power management circuit 910 may determine line power differences for one or more sets of adjacent lines of pixel data. When two adjacent lines of pixel data use significantly different amounts of power (e.g., two lines with a power difference above a threshold), load transients can occur in the provided supply voltage. In some cases, if care is not taken, the supply voltage can fall below a minimum value, during a transient, below which insufficient power may be available for operating the display pixels. However, power management circuit 910 can identify adjacent lines of pixel data with significantly different power usage and can cause signal generator 912 to generate and provide a power boost signal along output path 907 to PMIC 802.

Responsive to receiving a power boost signal from TCON 800, PMIC 802 temporarily increases the supply voltage to prevent the transient from causing the supply voltage to fall below a minimum value. In this way, the transient load response for PMIC 802 and display panel 803 can be improved. As would be understood by one skilled in the art, a delay element 914 may be provided for the difference comparison.

TCON 800 may provide power control signals (e.g., a power command for setting the supply voltage along path 906 and/or a power boost command for transient improvement) while holding the next line of pixel data in line buffers 904 to allow PMIC 802 to pre-compensate for upcoming display content to be displayed. However, as noted herein, in some operational scenarios, TCON 800 provides power control signals along path 906 and display data along path 908 concurrently for real-time line-by-line content-based power control for display panel 102.

Figure 10:
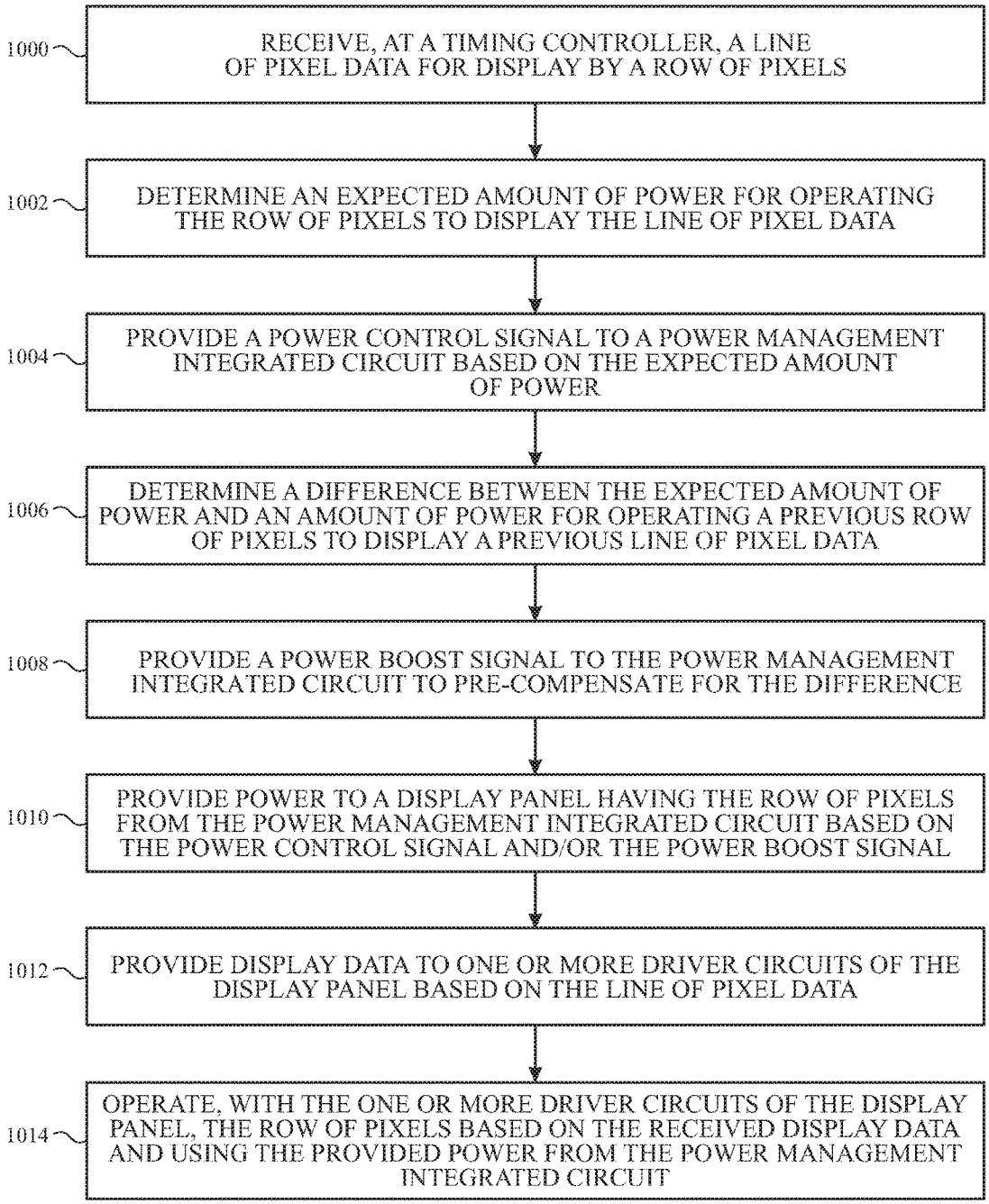
FIG. 10 is a flow chart of illustrative operations that may be performed for content-based power management for electronic device displays in accordance with various aspects of the subject technology.

FIG. 10 depicts a flow diagram of an example process for content-based power management for an electronic device display in accordance with various aspects of the subject technology. For explanatory purposes, the example process of FIG. 10 is described herein with reference to the components of FIGS. 1A, 1B, and 7-9. Further for explanatory purposes, the blocks of the example process of FIG. 10 are described herein as occurring in series, or linearly. However, multiple blocks of the example process of FIG. 10 may occur in parallel. In addition, the blocks of the example process of FIG. 10 need not be performed in the order shown and/or one or more of the blocks of the example process of FIG. 10 need not be performed.

In the depicted example flow diagram, at block 1000, a line of pixel data such as line 900 of FIG. 9 is received at a timing controller such as TCON 800. The line of pixel data may be provided for operation of a row of pixels of a display panel of an electronic device display.

At block 1002, the TCON determines an expected amount of power to be used by a display panel such as display panel 803 for operating the row of pixels to display the line of pixel data.

At block 1004, a power control signal is provided from the TCON to a power management integrated circuit (PMIC) such as PMIC 802 of FIG. 8, based on the expected amount of power (e.g., along a path 906 as in FIG. 9).

At block 1006, the TCON may optionally determine a difference between the expected amount of power and an amount of power for operating a previous row of pixels to display a previous line of pixel data.

At block 1008, the TCON may optionally provide a power boost signal to the power management integrated circuit to pre-compensate for the difference between the expected amount of power and the amount of power for operating the previous row of pixels.

At block 1010, the PMIC provides power to a display panel having the row of pixels (see, e.g., display panel 803 of FIG. 8) based on the power control signal and/or the power boost signal. Providing power to the display panel includes providing a supply voltage to the display panel. Although the supply voltage may be modified for the display of each line of pixel data (and for each row of pixels), the supply voltage may be a global supply voltage for the entire display panel. Providing power based on the power control signal may help increase or decrease a supply voltage for the display panel on a line-by-line basis to reduce power consumption by the display panel (particularly when low power is needed and the supplied power is reduced for a particular line). Providing power based on the power boost signal may help improve the load transient response for display panel 803 and PMIC 802.

At block 1012, display data is provided from the TCON to the display panel (e.g., to one or more driver circuits of the display panel such as column driver and/or row driver circuits) based on the received line of pixel data. The display data may be digital display data that is the same as the line or pixel data or may be display data that is conditioned or converted pixel data for the display panel driver circuits. Power may be provided by the PMIC based on the power control signal and/or the power boost signal in advance of providing the display data from the TCON to the display panel (e.g., while the display data and/or the pixel data is stored in a line buffer in the TCON) so that the PMIC can pre-compensate for an upcoming load transient or power may be provided by the PMIC based on the power control signal and/or the power boost signal at the same time as the display data is provided to the display panel.

At block 1014, the row of pixels is operated (e.g., by the one or more driver circuits of the display panel) based on the received display data and using the provided power from the power management integrated circuit. Operating the row of pixels based on the received display data includes illuminating, using the power provided from the PMIC, each pixel in the row according to a pixel value in the display data as indicated by the pixel data received at the TCON. It will be appreciated that the operations of FIG. 10 can be repeated for each line of display data and for each display frame during operation of the display.

In accordance with various aspects of the disclosure, an electronic device having a display is provided, the display including a display panel having a matrix of pixels and one or more driver circuits for operating the matrix of pixels. The display also includes a timing controller configured to receive a line of pixel data for display by a row of pixels in the matrix of pixels. The display also includes a power management integrated circuit configured to provide power to the display panel for operation of the matrix of pixels. The timing controller is configured to provide a power control signal to the power management integrated circuit based on the received line of pixel data. The timing controller is also configured to provide display data to at least one of the one or more driver circuits based on the received line of pixel data. The power management integrated circuit is configured to provide power to the display panel based on the power control signal In accordance with other aspects of the disclosure, a method is provided that includes receiving, at a timing controller for an electronic device display, a line of pixel data to be displayed using a line of pixels in a display panel of the display. The method also includes determining, with the timing controller, an expected amount of power to be used to operate the line of pixels to display the line of pixel data. The method also includes providing a power command to a power management integrated circuit from the timing controller based on the determined expected amount of power.

In accordance with other aspects of the disclosure, a method is provided that includes storing, in a first line buffer of a timing controller of an electronic device display, a first line of pixel data to be displayed with a first row of pixels in the electronic device display. The method also includes storing, in a second line buffer of the timing controller, a previous line of pixel data previously or currently displayed with a second row of pixels in the electronic device display. The method also includes providing power from a power management integrated circuit to a display panel of the electronic device display based on the previous line of pixel data. The method also includes determining, with the timing controller, a power difference for the stored line of pixel data and the stored previous line of pixel data. The method also includes providing a power boost command from the timing controller to the power management integrated circuit based on the determined power difference.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable storage medium. The computer readable storage medium can be any data storage device that can store data which can thereafter be read by a computer system. Examples of the computer readable storage medium include read-only memory, random-access memory, CD-ROMs, HDDs, DVDs, magnetic tape, and optical data storage devices. The computer readable storage medium can also be distributed over network-coupled computer systems so that the computer readable code is stored and executed in a distributed fashion. In some embodiments, the computer readable storage medium can be non-transitory.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. An electronic device having a display, the display comprising:

a display panel having a matrix of pixels and one or more driver circuits for operating the matrix of pixels;

a timing controller configured to receive a line of pixel data for display by a row of pixels in the matrix of pixels; and a power management integrated circuit configured to provide power to the display panel for operation of the matrix of pixels, wherein the timing controller is configured to:

provide a power control signal to the power management integrated circuit based on the received line of pixel data, and provide display data to at least one of the one or more driver circuits based on the received line of pixel data; and wherein the power management integrated circuit is configured to provide power to the display panel based on the power control signal;

receive a subsequent line of pixel data for display by a subsequent row of pixels in the matrix of pixels;

provide a subsequent power control signal to the power management integrated circuit based on the received subsequent line of pixel data; and provide subsequent display data to at least one of the one or more driver circuits based on the received subsequent line of pixel data;

wherein the line of pixel data and the subsequent line of pixel data are lines of pixel data in a common display frame;

the timing controller further includes:

first and second line buffers configured to store the line of pixel data and the subsequent line of pixel data; and a power management circuit coupled to the first and second line buffers, the power management circuit configured to:

determine a line power for operating the row of pixels to display the line of pixel data;

determine a subsequent line power for operating the subsequent row of pixels to display the subsequent line of pixel data;

determine a difference between the line power and the subsequent line power; and provide a power boost signal to the power management integrated circuit if the difference is greater than a threshold.

2. The electronic device of claim 1, wherein the one or more driver circuits are configured to operate the row of pixels based on the display data using the power provided by the power management integrated circuit.

3. The electronic device of claim 1, wherein the power management integrated circuit is configured to provide a power boost to the display panel responsive to the power boost signal while the second line buffer stores the subsequent line of pixel data to pre-compensate for the difference between line power and the subsequent line power.

4. The electronic device of claim 3, wherein the timing controller is configured to provide display data based on the subsequent line of pixel data to the one or more driver circuits after the power management integrated circuit begins providing the power boost to the display panel.

5. A method, comprising:

receiving, at a timing controller for an electronic device display, a line of pixel data to be displayed using a line of pixels in a display panel of the display;

determining, with the timing controller, an expected amount of power to be used to operate the line of pixels to display the line of pixel data;

providing a power command to a power management integrated circuit from the timing controller based on the determined expected amount of power;

storing, in a first line buffer of the timing controller, the line of pixel data;

storing, in a second line buffer of the timing controller, a previous line of pixel data;

determining, with the timing controller, a power difference for the stored line of pixel data and the stored previous line of pixel data; and providing a power boost command to the power management integrated circuit based on the determined power difference.

6. The method of claim 5, further comprising providing power from the power management integrated circuit to the display panel responsive to the power command from the timing controller.

7. The method of claim 6, further comprising providing display data based on the line of pixel data to the display panel from the timing controller.

8. The method of claim 7, further comprising operating the line of pixels with the display panel based on the display data from the timing controller using the power provided by the power management integrated circuit based on the power command.

9. The method of claim 5, further comprising:

receiving, at the timing controller for an electronic device display, a next line of pixel data to be displayed using a next line of pixels in the display panel;

determining, with the timing controller, a new expected amount of power to be used to operate the next line of pixels to display the next line of pixel data; and providing a new power command to the power management integrated circuit from the timing controller based on the determined new expected amount of power.

10. The method of claim 5, further comprising temporarily increasing a supply voltage from the power management integrated circuit to the display panel responsive to the power boost command.

11. The method of claim 10, further comprising:

providing display data based on the line of pixel data to the display panel from the timing controller while temporarily increasing the supply voltage.

12. The method of claim 11, further comprising operating the line of pixels with the display panel based on the display data from the timing controller while and after temporarily increasing the supply voltage.

13. A method, comprising:

storing, in a first line buffer of a timing controller of an electronic device display, a first line of pixel data to be displayed with a first row of pixels in the electronic device display;

storing, in a second line buffer of the timing controller, a previous line of pixel data previously or currently displayed with a second row of pixels in the electronic device display;

providing power from a power management integrated circuit to a display panel of the electronic device display based on the previous line of pixel data;

determining, with the timing controller, a power difference for the stored line of pixel data and the stored previous line of pixel data; and providing a power boost command from the timing controller to the power management integrated circuit based on the determined power difference.

14. The method of claim 13, further comprising providing a power boost from the power management integrated circuit to the display panel of the electronic device display responsive to the power boost command from the timing controller.

15. The method of claim 14, further comprising operating the first row of pixels based on the first line of pixel data during and after the power boost from the power management integrated circuit.

16. The method of claim 15, further comprising:

providing power from the power management integrated circuit based on the first line of pixel data while operating the first row of pixels and after the power boost from the power management integrated circuit.

17. An apparatus comprising:

a display panel;

a time controller including:

a first line buffer configured to store a first line of pixel data to be displayed with a first row of pixels in the display panel;

a second line buffer configured to store a previous line of pixel data previously or currently displayed with a second row of pixels in the display panel;

a power management integrated circuit configured to provide power to the display panel based on the previous line of pixel data;

the time controller configured to determine a power difference for the stored line of pixel data and the stored previous line of pixel data, and to a power boost to the power management integrated circuit based on the determined power difference.

18. The apparatus of claim 17, further comprising providing a power boost from the power management integrated circuit to the display panel of the electronic device display responsive to the power boost command from the timing controller.

19. The apparatus of claim 18, further comprising operating the first row of pixels based on the first line of pixel data during and after the power boost from the power management integrated circuit.

20. The apparatus of claim 19, wherein the power management integrated circuit is further configured to provide power based on the first line of pixel data while operating the first row of pixels and after the power boost from the power management integrated circuit.

* * * * *